US006409021B1

(12) United States Patent
Ramirez et al.

(10) Patent No.: US 6,409,021 B1
(45) Date of Patent: Jun. 25, 2002

(54) FOOD SERVING TRAY

(75) Inventors: Richard L. Ramirez, Lawrenceville; Mark A. Bergeron, Lithonia, both of GA (US)

(73) Assignee: Tekni-Plex, Inc., Somerville, NJ (US)

( * ) Notice: Subject to any disclaimer, the term of this patent is extended or adjusted under 35 U.S.C. 154(b) by 0 days.

(21) Appl. No.: 09/639,594

(22) Filed: Aug. 16, 2000

(51) Int. Cl.[7] ..... B65D 1/36

(52) U.S. Cl. ..... 206/564; D7/555; 220/575; 229/407

(58) Field of Search ..... 206/561, 564; 229/406, 407; 220/555, 574, 575; D7/555–557

(56) References Cited

U.S. PATENT DOCUMENTS 3,420,431 A * 1/1969 Donovan ..... 229/407
3,655,110 A * 4/1972 Eisenbach ..... 229/406
D223,657 S 5/1972 Reifers et al.
4,718,555 A * 1/1988 Amberg ..... 206/564
5,050,791 A 9/1991 Bowden et al.
5,244,094 A * 9/1993 Graff, Jr. et al. ..... 206/564
5,335,787 A 8/1994 Finchum et al. ..... 206/564
5,934,472 A 8/1999 Ramirez et al. ..... 206/557

* cited by examiner

*Primary Examiner*—Jim Foster
(74) *Attorney, Agent, or Firm*—Hoffmann & Baron, LLP

(57) ABSTRACT

A food serving tray, preferably of polystyrene foam, is provided having a base and bounding side walls. The base is formed with at least two bottom walls and at least one partition interposed therebetween. To provide enhanced stability and rigidity to the tray, protrusions, preferably step-shaped, are formed in the side walls located between the crests of the partitions and the top edges of the side walls. The protrusions provide changes in direction in the side walls which enhance the strength and rigidity of the tray. In addition, the bottom walls may be dished concavely so as to have portions extend upwardly. Under loading, the dished bottom walls become flattened and bi-axially stressed to further enhance the overall strength and stability of the tray.

9 Claims, 5 Drawing Sheets

FOOD SERVING TRAY

BACKGROUND OF THE INVENTION

This invention relates to food serving trays and, more particularly, to food serving trays comprising foam.

Polystyrene foam food serving trays are known in the prior art. This body of prior art includes partitioned trays, such as that shown in FIG. 1. Specifically, with reference to FIG. 1, a polystyrene foam tray 1 includes integrally formed bottom walls 2, bounding side walls 3, and a matrix of partitions 4 arranged to define a plurality of compartments 5. The tray 1 can be used to serve simultaneously a plurality of different foods in the compartments 5 with little or no mixing between the different types of foods, as well as, to reduce heat conduction between hot foods and cold foods (thereby preserving the heat of the hot foods).

As more clearly shown in FIG. 1A, the partitions 4 are recessed below the side walls 3. Also, the tray 1 is formed to nest with a similarly formed tray, with the partitions 4 being each formed to encompass an interior volume 6. The partitions 4 of one of the trays 1 can be nestingly received within the interior volumes 6 defined by another of the trays 1 in a nested arrangement. It should be noted that the side walls 3 are formed generally flat between crests 7 of the partitions 4 and top edges 8 of the side walls 3.

In the prior art, foam trays, such as that shown in FIG. 1, are often thermoformed from a single foam sheet. The strength of a resulting tray is generally a function of the shape and structural features of the tray, as well as the amount of foam material used to form the tray. (Assuming no changes in materials—different materials will, of course, change the strength of the tray.) To vary the strength characteristics of the tray, the amount of foam material can be varied by increasing/decreasing the thickness of the foam sheeting and/or varying the molding characteristics used in forming the foam sheeting (e.g., varying the porosity of the material). In essence, the strength of the tray is a direct function of the weight of the tray. As mentioned above, differences in additives and/or constituent materials will of course have an effect.

To reduce the amount of raw material needed to form a tray, it is desired to enhance the tray's structural integrity through the formation of structural features which impart additional strength and stability to the tray. In this manner, the amount of raw material necessary to form the constituent foam material can be reduced, and thus there are cost savings, without sacrificing the strength of the tray. As can be appreciated, maximum tray strength is desired to accommodate the loading of food, with minimal chance of tray failure.

It is an object of the subject invention to provide a tray, preferably of polystyrene foam, which is capable of bearing the same amount of weight as prior art trays, but requiring less foam material for formation than in the prior art.

SUMMARY OF THE INVENTION

The aforementioned object is met by a food serving tray, formed preferably of polystyrene foam, having a base, which includes bottom walls and partitions, the partitions being interposed between, and connecting, the bottom walls; and side walls extending from, and bounding, the base. The partitions intersect the side walls and subdivide the volume encompassed by the tray into compartments. In accordance with a first aspect of the subject invention, the partitions are formed to be wholly recessed below the side walls, such that the crests of the partitions are spaced from the top edges of the side walls. In addition, a protrusion, preferably directed inwardly, is formed between each intersection defined at the juncture of one of the partitions with one of the side walls, and the top edge of the relevant side wall. Advantageously, the protrusion causes a change in direction of the material forming the side wall, and thereby imparts additional structural rigidity to the tray. With the additionally rigidity, the overall weight of the tray can be reduced, thereby saving on raw material without sacrificing strength of the tray.

Preferably, each of the protrusions is shaped as a step having a relatively planar upwardly facing top surface and a tapered riser surface that follows an arcuate path. More preferably, two step-shaped protrusions are provided above each intersection of partition and side wall, with a larger step protrusion being formed to extend from the crest of the respective partition to a point intermediate the partition and the adjacent top edge of the side wall. The second step-shaped protrusion is smaller in size, extends from the top surface of the larger protrusion, and has its top surface generally coplanar with the top edge of the side wall. The two step configuration defines a tapered socket which can accommodate the finger(s) of a person handling the tray. With the prior art, no tapered socket existed, since the side walls were formed generally flat between the crests of the partitions and the top edges of the side walls.

The coplanarity of the top edges of the side walls and the top surfaces of the second protrusions in effect widens the top edges, thereby providing additional strength. The top edges of the side walls collectively define a flange that encircles the tray. The widening of portions of the flange increases the overall strength of the flange and the tray. In sum, the changes in direction in the side walls provided by the protrusions and the widened flange portions enhance the strength and stability of the tray beyond what is found in the prior art.

In a second aspect of the invention, at least one of the bottom walls of the base is dished so as to be concave and extend upwardly. Advantageously, with load being applied to a bottom wall (such as from food being placed in a compartment), the bottom wall is forced downwardly and bi-axially stressed into a generally flat state which strengthens the respective bottom wall and imparts stability to the overall tray.

These and other features of the invention will be better understood through a study of the following detailed description and accompanying drawings.

DETAILED DESCRIPTION OF THE INVENTION

Figure 4:
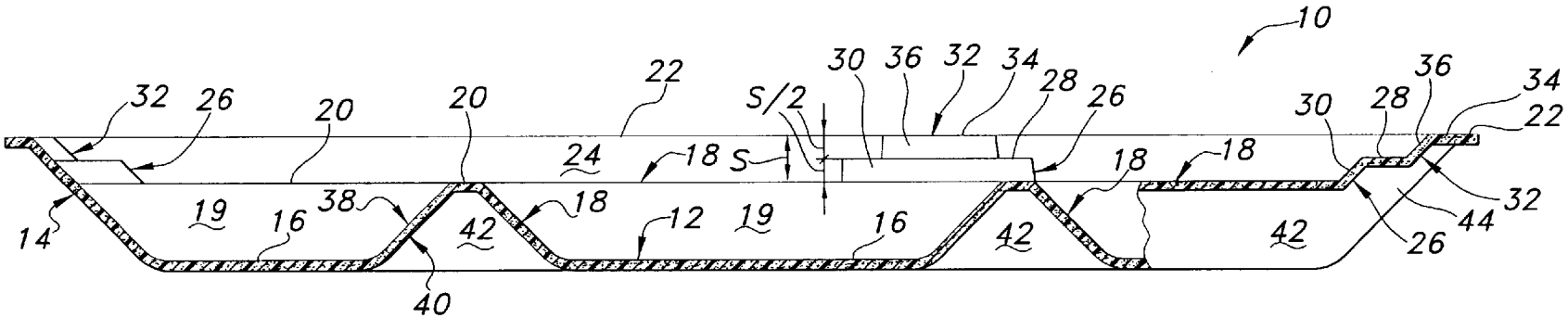
FIG. 4 is a cross-sectional view taken along line 4—4 in FIG.3.
Figure 2:
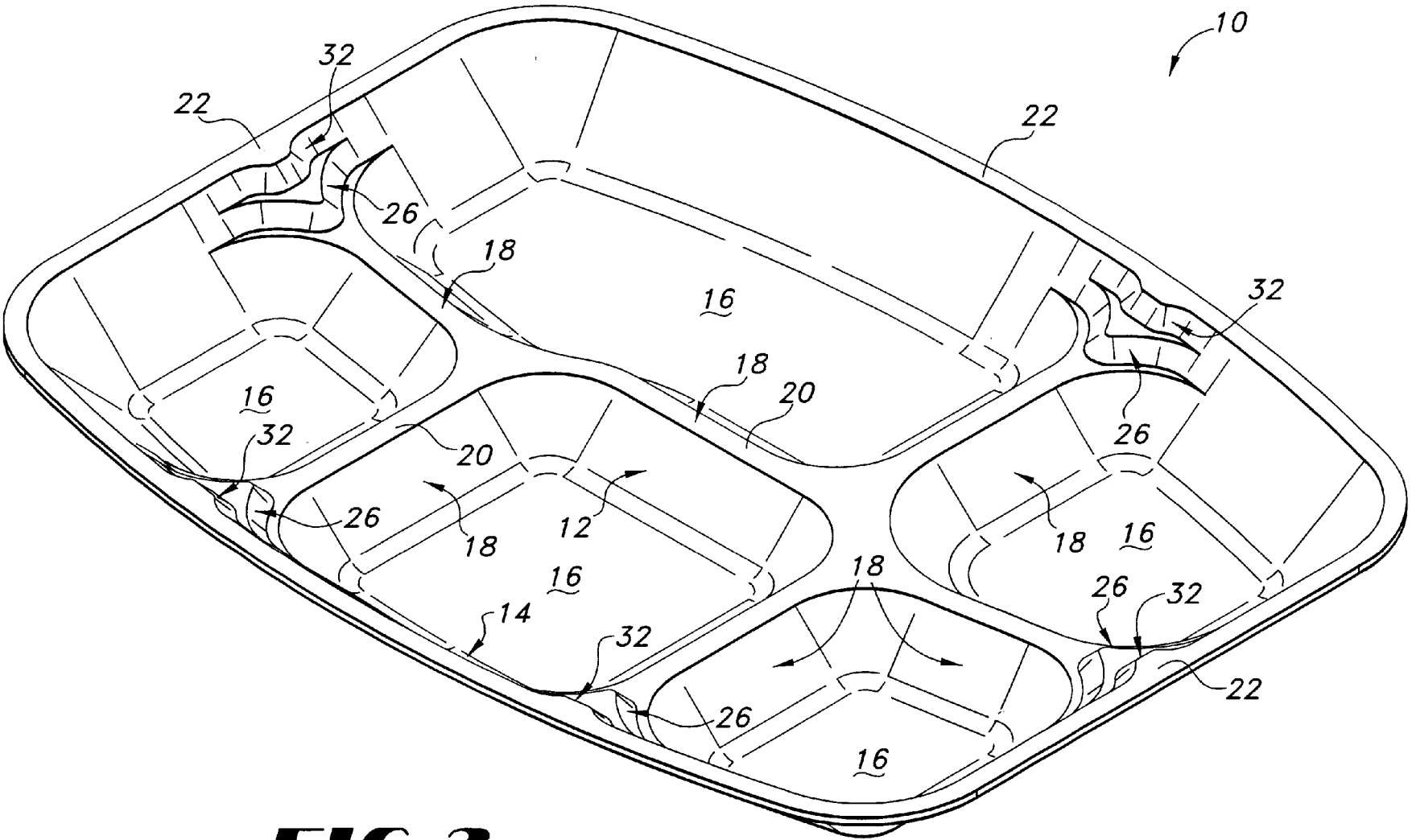
FIG. 2 is a perspective view of a new and inventive food serving tray.
Figure 3:
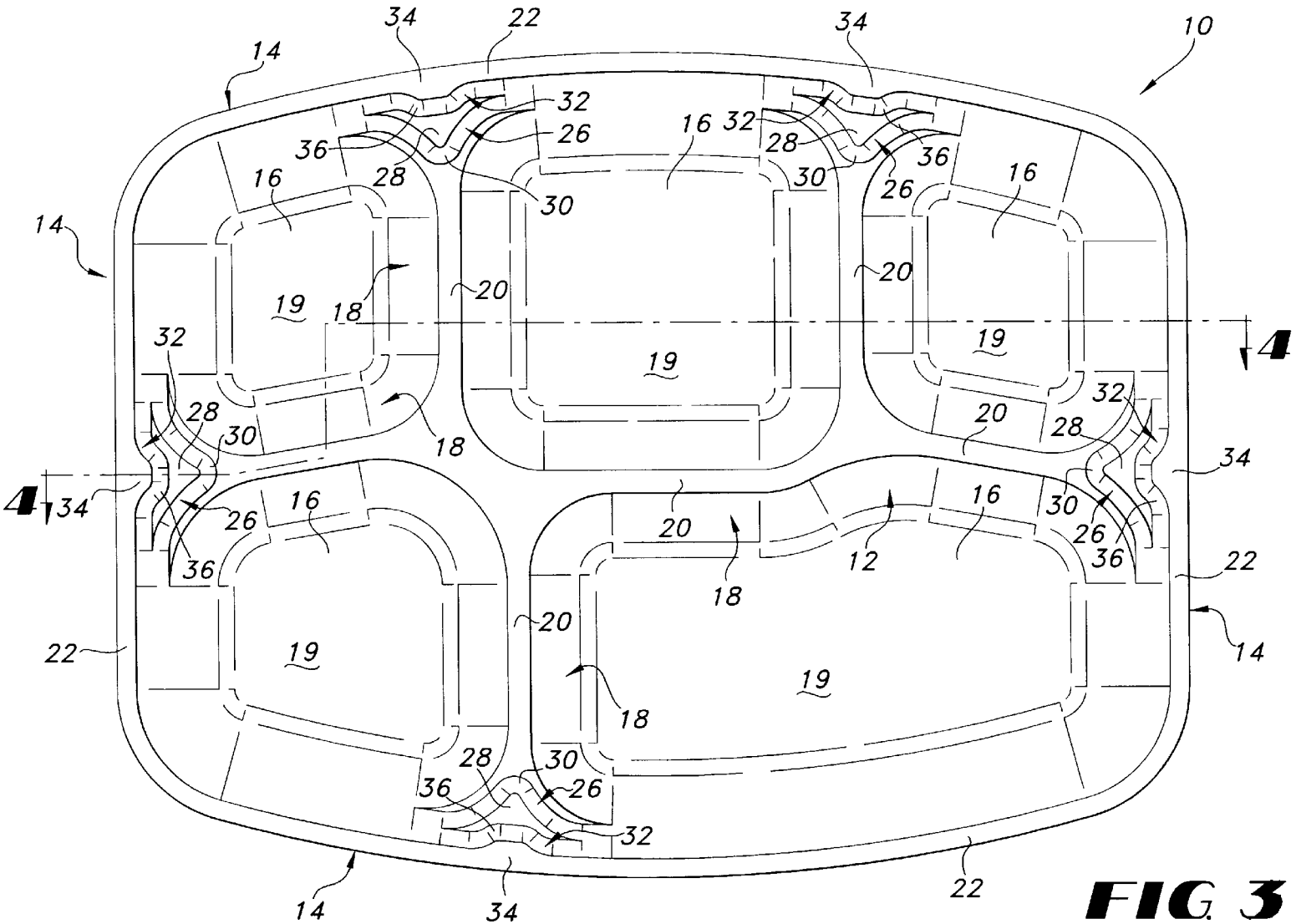
FIG. 3 is a top plan view of the new and inventive tray.

Referring generally to FIGS. 2–4, a food serving tray is depicted and generally designated with the reference numeral 10. Using techniques known to those skilled in the art (e.g. thermoforming), the tray 10 is unitarily formed of polystyrene foam and generally includes a base 12, and side walls 14 which bound the base 12.

The base 12 includes bottom walls 16 and partitions 18. The partitions 18 are interposed between the bottom walls 16 so as to define a matrix. In addition, the partitions 18 extend to and intersect with the side walls 14. Accordingly, the side walls 14, the bottom walls 16, and the partitions 18 collectively define a plurality of compartments 19. As is readily appreciated, the quantity and arrangement of the partitions 18 can be readily altered to change the quantity, size, and shape of the compartments 19.

In a first aspect of the invention, the partitions 18 have crests 20 which are recessed below top edges 22 of the side walls 14, as shown in FIG. 4. In this manner, the partitions 18 are wholly located within a volume 24 generally defined by the base 12 and the side walls 14. In addition, first protrusions 26 are formed in the side walls 14 located between the crests 20 and the top edges 22. Preferably, the first protrusions 26 are directed inwardly, and are each formed with a step-shape, having a generally planar top surface 28, and an outwardly facing riser surface 30, which extends between the respective crest 20 and the respective top surface 28. The riser surface 30 is also preferably tapered and follows an arcuate path to have a central portion that extends further inward than other portions.

It is also preferred that second protrusions 32 be formed in the side walls 14 located between the first protrusions 26 and the top edges 22. The second protrusions 32 are also preferably step-shaped, having generally planar second top surfaces 34 and second riser surfaces 36 which extend between the top surfaces 28 of the first protrusions 26 and the second top surfaces 34 of the second protrusions 32. It is preferred that the second top surfaces 34 be generally coplanar with the top edges 22. It is further preferred that each of the second riser surfaces 36, like the riser surfaces 30, be tapered and arcuately formed to have the largest inward extent generally at its center.

With the second top surfaces 34 being coplanar with the top edges 22, the top edges 22 are in effect widened at those locations. The top edges 22 collectively define a flange that encircles the tray 10. By widening portions of the flange, the overall strength and stability of the flange, and thus the tray 10, are increased.

It is also preferred that with the first and second protrusions 26 and 32 being utilized, the top surfaces 28 of the first protrusions 26 are located midway between the crests 20 and the top edges 22. Specifically, referring to FIG. 4, with the crests 20 being located a distance S below the top edges 22, the top surfaces 28 are located a distance S/2 from both the crests 20 and the top edges 22.

The first and second protrusions 26, 32 advantageously provide changes in direction in the structure of the side walls 14 which impart additional rigidity and strength to the overall tray 10. Moreover, the coplanarity of the second top surfaces 34 and the top edges 22 also enhance the strength of the overall tray 10. Accordingly, the overall amount of foam material required to form the tray 10 can be reduced. It has been found by the inventors herein that a 10–20% reduction in weight can be achieved by including the protrusions 26, 32 and arranging the second top surfaces 34 and the top edges 22, as discussed above (when compared with similar prior art trays which are constructed in similar fashion except for the use of the protrusions 26, 32 and having the edges and surfaces 22 and 34 be coplanar).

Figure 6:
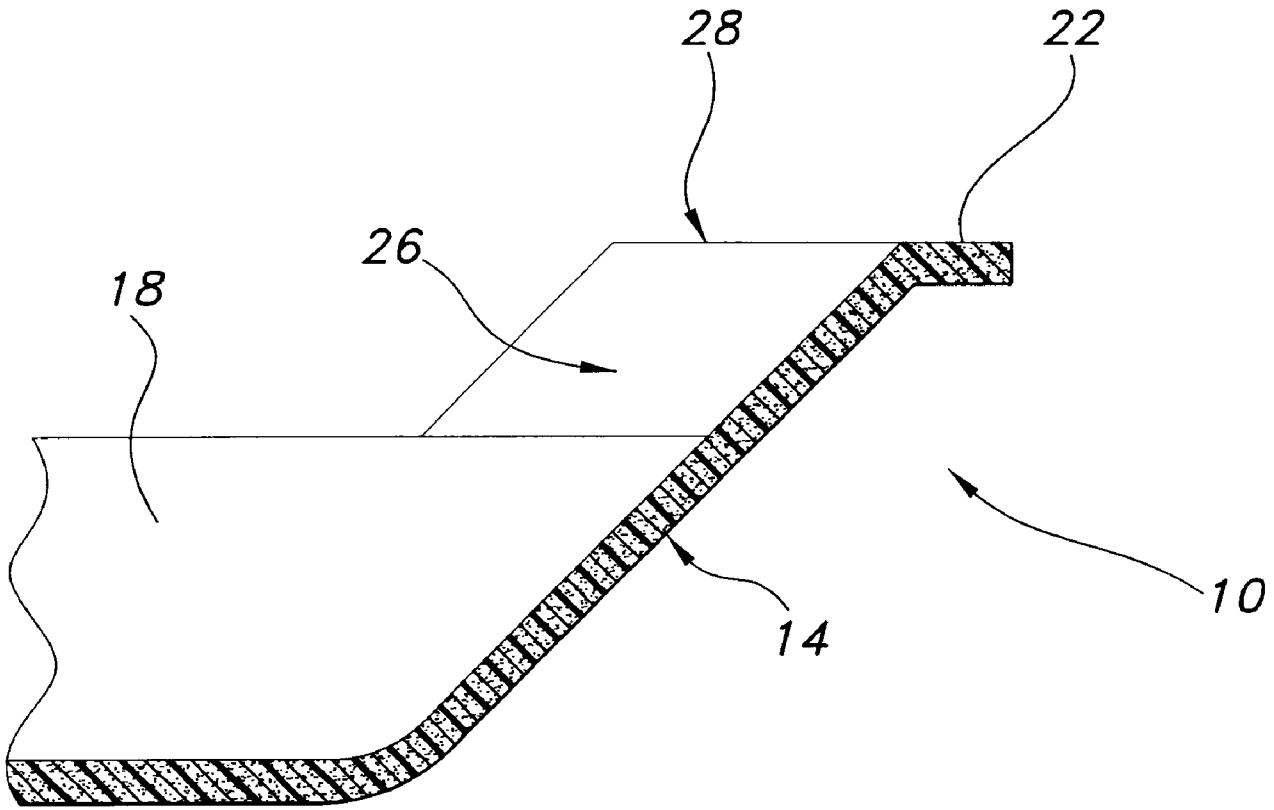

If only the first protrusions 26 are utilized, as shown in FIG. 6, the top surfaces 28 may be formed coplanar with the top edges 22.

It is also preferred that the tray 10 be formed to nest with a similarly-formed tray. Accordingly, as best shown in FIG. 4, the walls 14, 16 and the partitions 18 of the tray 10 are formed with generally parallel inner and outer surfaces 38 and 40. As a result, an interior volume 42 is defined within each of the partitions 18, wherein the partitions of a second similarly-formed tray (not shown) can be nestingly received.

Furthermore and referring to FIG. 4, it is preferred that the first protrusions 26 extend further into the volume 24 than the second protrusions 32. In this manner, each pair of the protrusions 26 and 32 collectively defines a tapered socket 44 enclosing an inner volume that blends into the interior volume 42 defined by the associated partition 18. Taking into consideration the tapered and arcuate shapes of the riser surfaces 30 and the second riser surfaces 36, the tapered sockets 44 extend furthest into the tray 10 at approximately the centers of the protrusions 26 and 32. The tapered sockets 44 are angled relative to the side walls 12 so that relatively wide mouths to the interior volumes 42 are provided. Accordingly, the tapered sockets 44 can comfortably accommodate the finger or fingers of a person holding the tray 10. In contrast to this inventive arrangement, a person had to bend his or her fingers about the side wall of the prior art tray at approximately a right angle and into the interior volume defined by the partition. No tapered sockets were provided.

It should be noted that markings are provided in the FIGS. to schematically represent changes in direction of various portions of the tray 10. In physical embodiments, the changes of direction are blended into the overall shape of the tray, and there are no clear demarcations of such changes.

Figure 1:
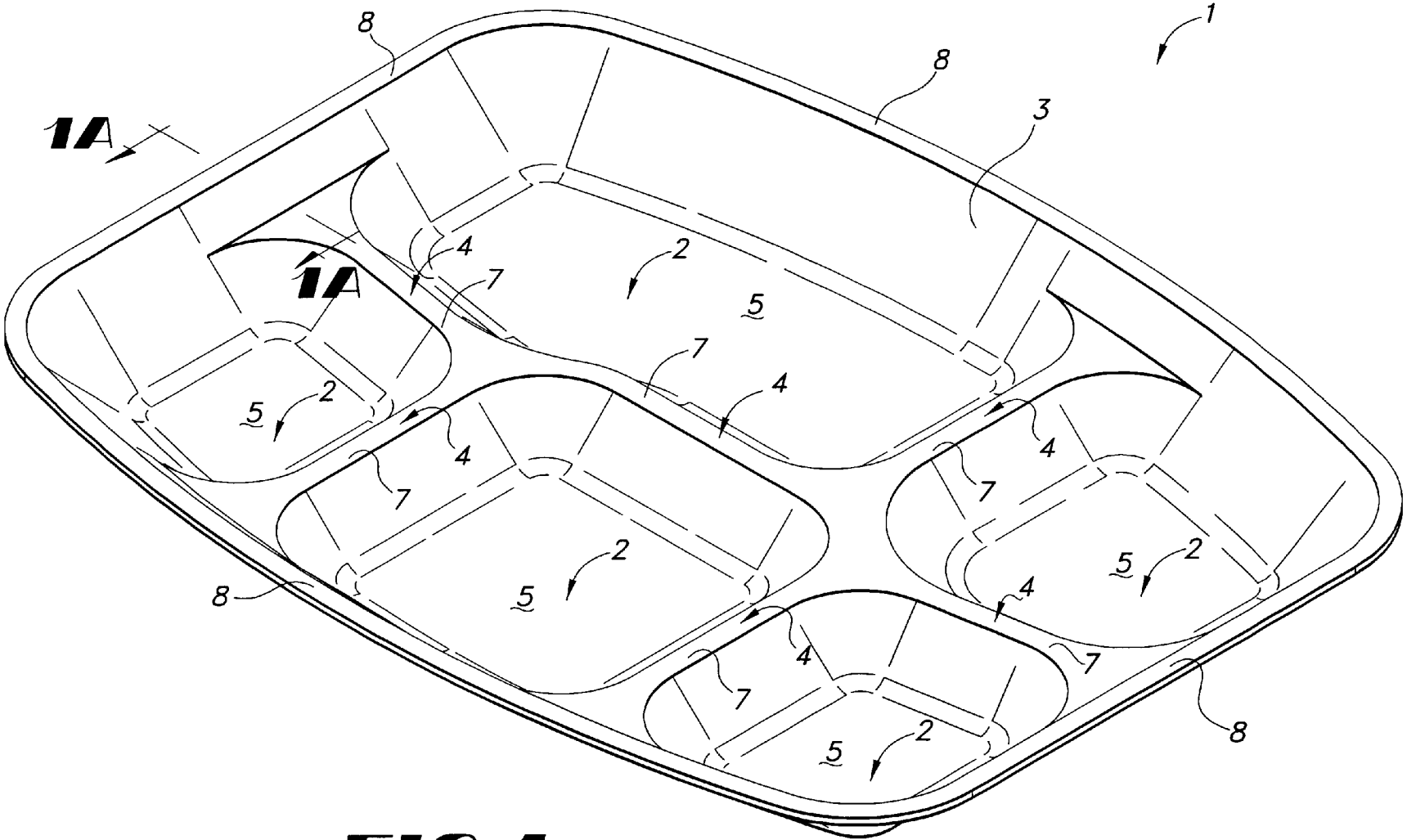
FIG. 1 (PRIOR ART)
FIG. 1 is a perspective view of a prior art food serving tray.
Figure 5:
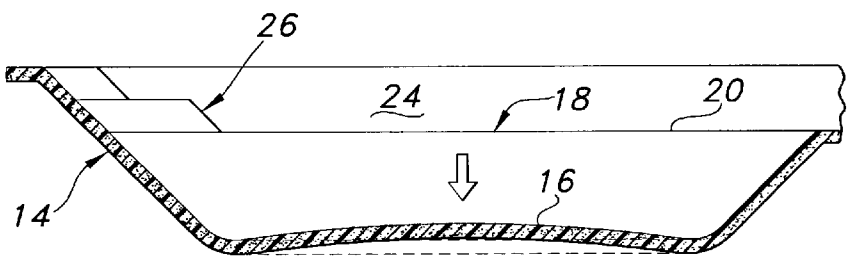
FIG. 5 is a partial cross-sectional view depicting a dished bottom wall formed in the base of the tray; and, FIG. 6 is a partial elevational view showing a single protrusion having a top surface coplanar with a top edge of the tray.
Figure 1A:
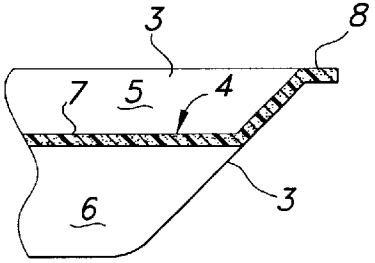
FIG. 1A (PRIOR ART)
FIG. 1A is a partial cross-sectional view taken along line 1A—1A of FIG. 1.

Referring to FIG. 5, in a second aspect of the invention, one or more of the bottom walls 16 is concavely dished upwardly so that portions thereof are raised into the volume 24. Preferably, the bottom walls 16 are formed concavely in two coordinate directions so that the centers of the respective bottom walls 16 are generally the highest portions thereof. With the dished structure, under loading and handling, as shown in dashed lines, the bottom walls 16 are forced into a flattened state and become bi-axially stressed. In this manner, the overall strength of the tray 10 can also be enhanced.

As is readily apparent, numerous modifications and changes may readily occur in those skilled in the art, and hence it is not desired to limit the invention to the exact construction and operation as shown and described, and accordingly all suitable modification equivalents may be resorted to falling within the scope of the invention as claimed.

What is claimed is:

1. A tray for serving food, said tray comprising:

a base having at least two bottom walls, and at least one partition interposed between, and connecting, two of said bottom walls; and a plurality of side walls extending from and bounding said base, wherein at least one of said partitions intersects with, and is connected to, a first of said side walls, wherein at least one first protrusion is formed in said first side wall located between a crest of said partition and a top edge of said first side wall, said first protrusion being step-shaped with a first top surface facing generally in the same direction as said base, and a first riser surface having at least portions extending between said crest of said partition and said first top surface, said first top surface being recessed below said side walls so as to be located within a volume encompassed by said base and said side walls, and wherein at least one second protrusion is formed in said first side wall located between said first top surface of said first protrusion and said top edge of said first side wall, said second protrusion being step-shaped with a second top surface facing generally in the same direction as said base, and a second riser surface having at least portions extending between said first top surface of said first protrusion and said second top surface, said second top surface having at least portions coplanar with said top edge of said first side wall.

2. A tray as in claim 1, wherein said first protrusion extends inwardly towards a volume encompassed by said base and said side walls.

3. A tray as in claim 1, wherein said first and second protrusions collectively define a tapered socket, whereby said tapered socket may accommodate at least one finger of a person handling the tray.

4. A tray as in claim 3, wherein said socket defines a continuous volume with an interior volume defined within said partition.

5. A tray as in claim 1, wherein at least one of said bottom walls is dished so as to have portions thereof raised into a volume encompassed by said base and said side walls relative to other portions of respective said bottom wall.

6. A tray as in claim 1, wherein the tray comprises polystyrene foam.

7. A tray as in claim 1, wherein said first top surface is generally planar.

8. A tray as in claim 7, wherein said second top surface is generally planar.

9. A tray as in claim 1, wherein said second top surface is generally planar.

* * * * *